United States Patent [19]

Stintzi

[11] 4,185,478

[45] Jan. 29, 1980

[54] PADLOCK BODY WITH PICK RESISTANT WARDED INSERT ASSEMBLAGE

[75] Inventor: Earl G. Stintzi, Menomonee Falls, Wis.

[73] Assignee: Master Lock Company, Milwaukee, Wis.

[21] Appl. No.: 924,963

[22] Filed: Jul. 17, 1978

[51] Int. Cl.[2] ..... E05B 67/22

[52] U.S. Cl. ..... 70/38 A; 70/346

[58] Field of Search ..... 70/346, 347, 38 A, 409

[56] References Cited

U.S. PATENT DOCUMENTS

| | | | |
|---|---|---|---|
| 1,183,494 | 5/1916 | Re | 70/346 |
| 1,885,983 | 11/1932 | Brauning | 70/346 |
| 3,475,930 | 11/1969 | Foote | 70/38 A |

FOREIGN PATENT DOCUMENTS

| | | | |
|---|---|---|---|
| 572820 | 2/1924 | France | 70/347 |

*Primary Examiner*—Robert L. Wolfe

*Attorney, Agent, or Firm*—Curtis B. Morsell, Sr.

[57] ABSTRACT

Certain types of key-operated padlocks are provided with warded inserts accessible for key insertion through an opening in the bottom of the padlock body. In the present structure when the proper key is inserted into the warded insert (housed within the padlock body) the cuts in an edge of the key shank match and register with similar cuts or notches in the insert permitting the key to be turned with the specially formed tip of the key engaging a web on the bottom of the plug extension blade within the lock body with special cuts or notches and nodules in and on the key tip engaging companion formations in and on the bottom of the plug extension whereby turning movement of the key will turn the plug extension to the extent necessary to retract certain shackle holding levers and thus release the padlock shackle.

3 Claims, 5 Drawing Figures

PADLOCK BODY WITH PICK RESISTANT WARDED INSERT ASSEMBLAGE

BACKGROUND OF THE INVENTION AND SUMMARY THEREOF

A general object of the invention is to provide in a warded, insert-equipped padlock, means for receiving the operating key including a web on the bottom of the plug extension formed with cuts or notches and nodules matching special cuts and/or notches and nodules in and on the tip of the key shank whereby turning movement of the special key is effective to turn the plug extension for shackle releasing purposes.

Further objects of the invention are to provide in a warded insert-equipped key operated padlock, novel co-acting means between the tip of the special operating key and the bottom of the plug extension which function efficiently and automatically, in which the mechanism of a certain lock is responsive only to the tip formation of the special key therefor, and in which the key tips for different locks may have a pair of different tip dispositions.

DESCRIPTION OF THE PRIOR ART

To the best of applicant's knowledge the closest approach to the structure of the instant invention is that found in U.S. Pat. No. 3,475,930 owned by the assignee of the instant application, but said prior art patent lacks the particular form of warded insert here disclosed and a plug extension blade having on its base cuts or nodules matching those on the tip of the particular key provided for the individual lock in question.

BRIEF DESCRIPTION OF THE DRAWING

In the accompanying drawing wherein the same reference characters indicate the same parts in all of the views.

DESCRIPTION OF THE PREFERRED EMBODIMENT

Figure 1:
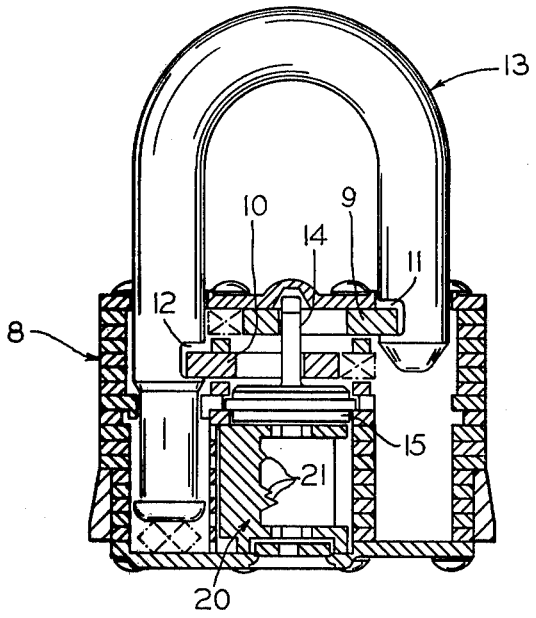
FIG. 1 is a vertical sectional view of the improved padlock with its pick resistant warded insert assemblage, the operating key being omitted.

Generally speaking the padlock of the present invention is of the type shown in U.S. Pat. No. 3,475,930, issued Nov. 4, 1969 and includes a laminated case or body 8 provided with a pair of spring loaded locking levers 9 & 10 movable in opposite directions and disposed in different planes so as to enter and engage notches or cuts 11 & 12 in the legs of a shackle 13 on different levels to provide so-called "heel & toe" locking. The structure includes mechanism to move both of said locking levers simultaneously featuring an extension blade 14. The bottom of said extension blade is formed with a key tip receiver 15 (see FIG. 4) having recesses and nodules 16 & 17 therein and thereon to match the special tip formation of the particular key 18 provided for the lock in question. There is also within the key tip receiver 15 a web 19 which, when contacted by a portion of the key tip, will cause the extension blade to turn upon turning movement of the key 18. Fixedly housed within a cavity therefor in the lower portion of the padlock body and opening exteriorally is an improved warded insert 20 provided with cuts and nodules 21 match those 22 on the blade of the special key 18 so that when the latter is manually turned it may turn within the fixed warded insert 20 to turn the extension blade 14, as previously mentioned.

Figure 2:
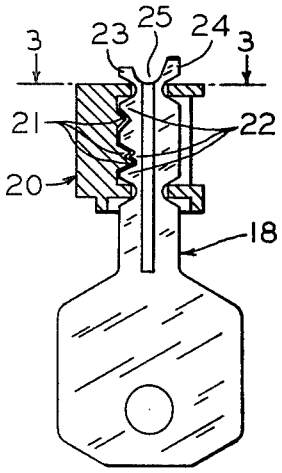
FIG. 2 is a vertical sectional view of the warded insert per se with the special key therefor inserted thereinto showing the cuts in the insert matching those on the special key.
Figure 3:
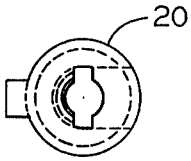
FIG. 3 is a top view of the warded insert, said view being taken approximately on line 3—3 in FIG. 2.
Figure 4:
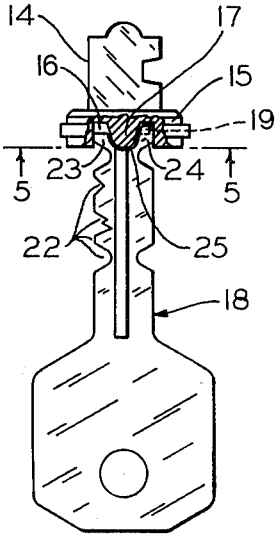
FIG. 4 is a view of the plug extension blade of the padlock with a portion thereof broken away and in section to show the cuts, nodules and web therein engaged by the tip of a special key.
Figure 5:
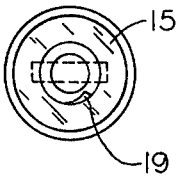
FIG. 5 is a bottom view of the plug extension blade taken approximately on line 5—5 of FIG. 4, with the key omitted.

The special key 18 operable only in the illustrated lock with its particular warded insert 20 and the specially formed key tip receiver 15 is shown in detail in FIGS. 2 & 4. As heretofor mentioned one edge of the key blade has the cuts and nodules 22 which match the cuts and nodules 21 in a portion of the warded insert adjacent the key-receiving opening therethrough. The tip of this particular key includes a short wing 23 at one side and a longer wing 24 at its other side, separated by a U-recess 25. For another form of key for a different lock the short and longer wings could be reversed.

The herein-described padlock body 8 is provided with an improved warded insert 20. Associated therewith is an extension blade 14 with its bottom being formed with a key tip receiver 15 which is pick resistant. The special key 18 which for different locks may have carried cuts and nodules 22 and a varied form of tip, in the instant disclosure is formed with cuts and nodules 22 matching those 21 in and on the insert 20. With the latter being fixedly housed within the padlock body, when the shank of the key is inserted into the insert 20, as in FIG. 2, it may be turned, whereupon the special cuts and nodules or wings in and on the key tip engage the companion cuts and nodules in and on the key tip receiver 15 and the web 19 on the latter will be engaged by a portion of the key tip. Further turning movement of the key will cause the extension blade 14 to turn to the extent necessary to retract the conventional shackle holding levers effecting release of the padlock shackle 13. Because turning of the extension blade 14 can only be accomplished by the intimate engagement between the specially formed tip of the key 18 and elements of the key tip receiver 15, the lock is pick resistant.

The present invention which is actually a warded insert and special key assembly for a padlock body, provides a simple, strong and pick resistant padlock structure which is free of manufacturing, assembly and operational complications, and is well adapted for the purposes set forth.

What is claimed is:

1. In combination, a padlock body including a warded insert housed within a portion of the bidy and accessible through a body wall opening for insertion of a key, a plug extension blade within the padlock body and having a key tip receiver adjacent the inner end portion of the warded insert and accessible through a key-tip opening in the latter, the key tip receiver being eccentrically formed and including circularly arranged recesses which contain depending nodules and a web, and a key insertable into said warded insert and having cuts and nodules along an edge of its shank matching those in a portion of the warded insert, the tip of the key being eccentrically formed to coact with the eccentric formation of the tip receiver of the extension blade whereby turning movement of the key, when the key tip is within the key tip receiver and is in engagement with said web, effects turning movement of the plug extension blade for padlock operating purposes.

2. The combination recited in claim 7 wherein there are operatively housed within the padlock body a pair of spring loaded shackle locking levers operatively engaged by the plug extension blade.

3. The combination recited in claim 8 wherein said locking levers are movable in opposite directions and are disposed in different planes.

* * * * *